US010808575B2

(12) United States Patent
Taxacher et al.

(10) Patent No.: US 10,808,575 B2
(45) Date of Patent: Oct. 20, 2020

(54) TURBINE COMPONENT ASSEMBLY

(71) Applicant: GENERAL ELECTRIC COMPANY, Schenectady, NY (US)

(72) Inventors: Glenn Curtis Taxacher, Simpsonville, SC (US); John McConnell Delvaux, Fountain Inn, SC (US); Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 403 days.

(21) Appl. No.: 15/624,070

(22) Filed: Jun. 15, 2017

(65) Prior Publication Data

US 2018/0363509 A1 Dec. 20, 2018

(51) Int. Cl.

| | |
|---|---|
| ***F01D 25/28*** | (2006.01) |
| ***F01D 9/04*** | (2006.01) |
| ***F23R 3/00*** | (2006.01) |
| ***F23R 3/60*** | (2006.01) |
| ***F01D 25/00*** | (2006.01) |

(52) U.S. Cl.

CPC ..... *F01D 25/28* (2013.01); *F01D 9/04* (2013.01); *F01D 25/005* (2013.01); *F23R 3/007* (2013.01); *F23R 3/60* (2013.01); *F05D 2240/11* (2013.01); *F05D 2240/35* (2013.01); *F05D 2250/184* (2013.01); *F05D 2250/61* (2013.01); *F05D 2260/52* (2013.01); *F05D 2300/10* (2013.01); *F05D 2300/6012* (2013.01); *F05D 2300/6033* (2013.01); *F05D 2300/611* (2013.01); *F23R 2900/00005* (2013.01); *F23R 2900/00017* (2013.01)

(58) Field of Classification Search

CPC ..... F05D 2260/52; F05D 2300/10; F05D 2300/6033; F01D 5/284; F01D 9/04; F01D 25/28; F23R 3/007; F23R 3/60

See application file for complete search history.

(56) References Cited

U.S. PATENT DOCUMENTS

| | | | | |
|---|---|---|---|---|
| 6,315,519 | B1 | 11/2001 | Bagepalli et al. | |
| 6,758,653 | B2 | 7/2004 | Morrison | |
| 7,249,462 | B2 * | 7/2007 | Aumont | F01D 9/023 415/209.3 |
| 8,167,546 | B2 | 5/2012 | Shi et al. | |
| 8,834,106 | B2 * | 9/2014 | Luczak | F01D 11/12 415/173.3 |
| 10,100,660 | B2 * | 10/2018 | Sippel | F01D 11/005 |

(Continued)

*Primary Examiner* — Arun Goyal

(74) *Attorney, Agent, or Firm* — McNees Wallace & Nurick LLC

(57) ABSTRACT

A turbine component assembly is disclosed, including a first component, a second component, and a circumferentially oriented flat spring. The first component is arranged to be disposed adjacent to a hot gas path, and includes a ceramic matrix composite composition. The second component is adjacent to the first component and arranged to be disposed distal from the hot gas path across the first component. The circumferentially oriented flat spring is disposed on and directly contacting the second component and directly contacting and supporting the first component as a compliant contact interface between the first component and the second component. The circumferentially oriented flat spring provides a radial spring compliance between the first component and the second component.

20 Claims, 3 Drawing Sheets

(56) References Cited

U.S. PATENT DOCUMENTS

| | | | | |
|---|---|---|---|---|
| 2009/0115141 | A1 | 5/2009 | Simmons | |
| 2016/0123172 | A1* | 5/2016 | Mondal | F01D 11/025 415/136 |

* cited by examiner

TURBINE COMPONENT ASSEMBLY

FIELD OF THE INVENTION

The present invention is directed to turbine component assemblies. More particularly, the present invention is directed to turbine component assemblies including compliant contact interfaces.

BACKGROUND OF THE INVENTION

Hot gas path components of gas turbines are subjected to high air loads and high acoustic loads during operation which, combined with the elevated temperatures and harsh environments, may damage the components over time. Both metal and ceramic matrix composite ("CMC") components may be vulnerable to such damage, although CMC components are typically regarded as being more susceptible than metallic counterparts, particularly where CMC components are adjacent to metallic components.

Damage from air loads and acoustic loads may be pronounced in certain components, such as turbine shrouds, which include a hot gas path-facing sub-component which is not fully secured to, but in contact with, a non-hot gas path-facing sub-component. By way of example, due to air loads and acoustic loads, the inner shroud of a turbine shroud assembly may vibrate against and be damaged by the outer shroud during operation. Further, loading an inner shroud to dampen air loads and acoustic loads may give rise to thermal binding between the CMC components and metal components, which can further damage the components.

BRIEF DESCRIPTION OF THE INVENTION

In an exemplary embodiment, a turbine component assembly includes a first component, a second component, and a circumferentially oriented flat spring. The first component is arranged to be disposed adjacent to a hot gas path, and includes a CMC composition. The second component is adjacent to the first component and arranged to be disposed distal from the hot gas path across the first component. The circumferentially oriented flat spring is disposed on and directly contacting the second component and directly contacting and supporting the first component as a compliant contact interface between the first component and the second component. The circumferentially oriented flat spring provides a radial spring compliance between the first component and the second component.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary turbine component assemblies. Embodiments of the present disclosure, in comparison to articles not utilizing one or more features disclosed herein, decrease costs, improve mechanical properties, increase component life, decrease maintenance requirements, eliminate spring coil failure, reduce or eliminate thermal binding, or combinations thereof.

Figure 1:
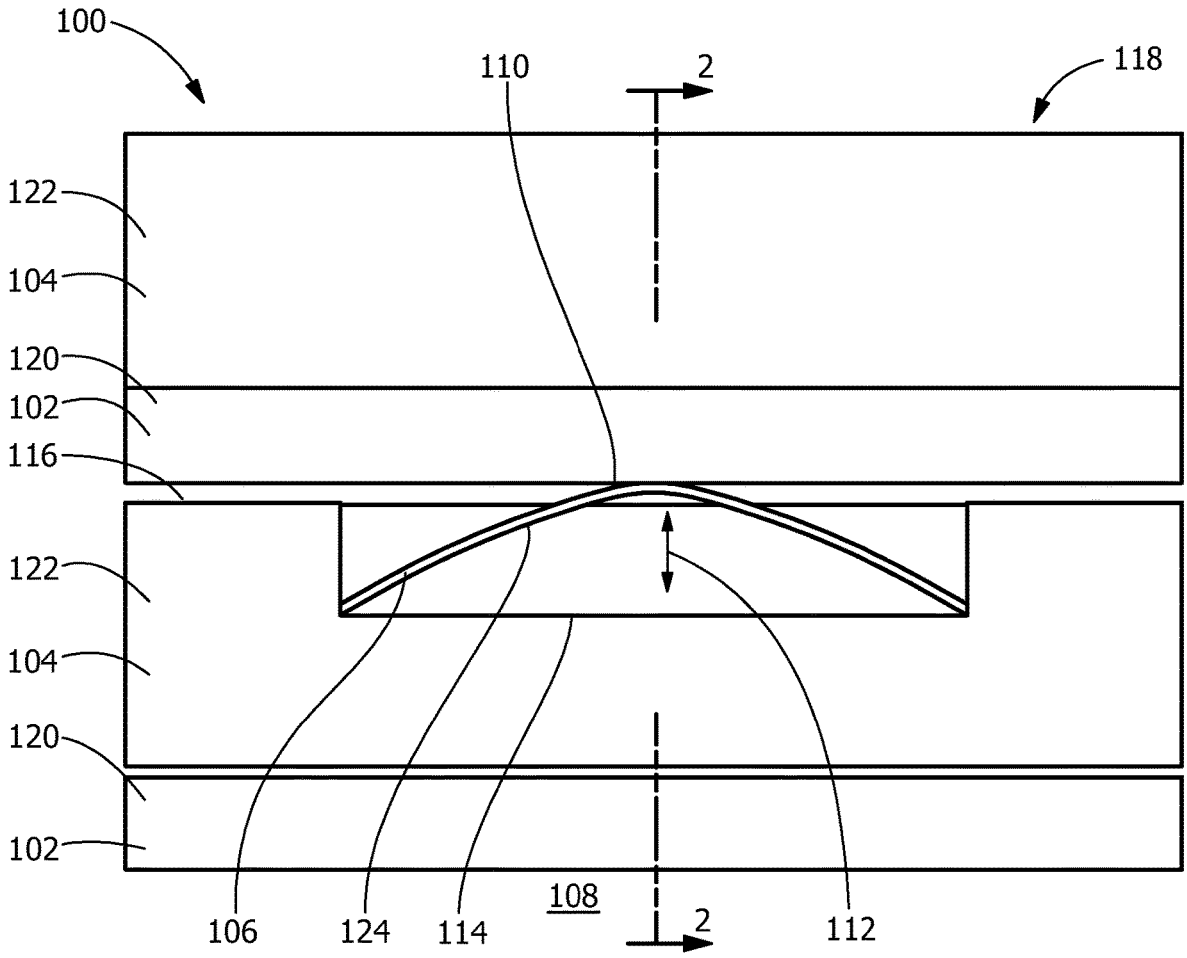
FIG. 1 is a cross-sectional view of a turbine component assembly, according to an embodiment of the present disclosure.
Figure 2:
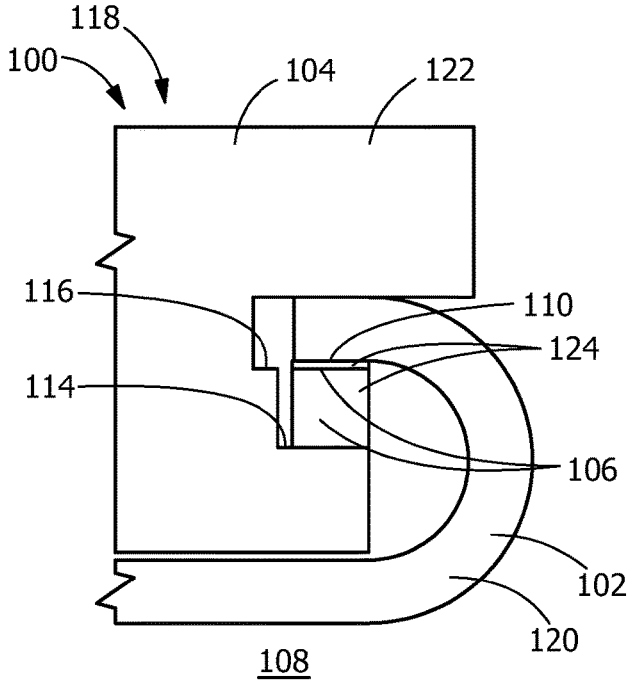
FIG. 2 is a perpendicular cross-sectional view along line 2-2 of the turbine component assembly of FIG. 1, according to an embodiment of the present disclosure.
Figure 3:
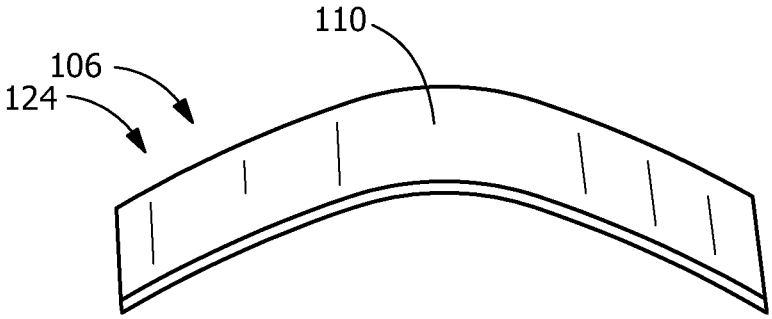
FIG. 3 is a perspective view of the circumferentially oriented flat spring of FIG. 1, according to an embodiment of the present disclosure.
Figure 4:
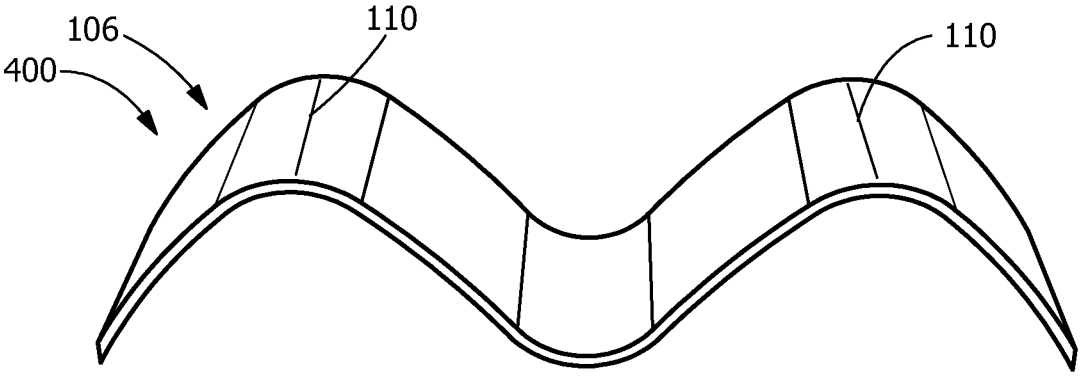
FIG. 4 is a perspective view of a sinusoidal circumferentially oriented flat spring, according to an embodiment of the present disclosure.
Figure 5:
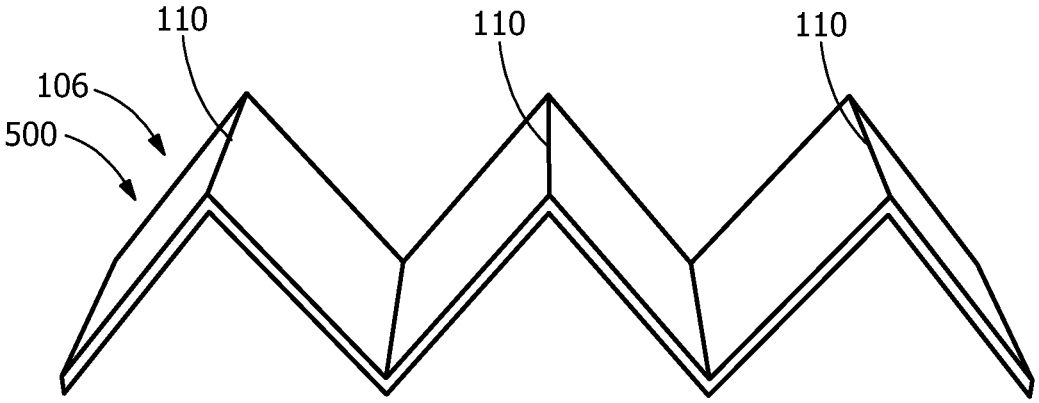
FIG. 5 is a perspective view of a corrugated circumferentially oriented flat spring, according to an embodiment of the present disclosure.

Referring to FIGS. 1-3, in one embodiment, a turbine component assembly 100 includes a first component 102, a second component 104, and a circumferentially oriented flat spring 106. The first component 102 is arranged to be disposed adjacent to a hot gas path 108, the first component 102 including a CMC composition. The second component 104 is adjacent to the first component 102 and arranged to be disposed distal from the hot gas path 108 across the first component 102. The circumferentially oriented flat spring 106 is disposed on and directly contacting the second component 104 and directly contacting and supporting the first component 102 as a compliant contact interface 110 between the first component 102 and the second component 104. The circumferentially oriented flat spring 106 provides a radial spring compliance 112 between the first component 102 and the second component 104.

In one embodiment, "circumferentially oriented" indicates alignment along a circumference of a turbine, and "radial" indicates a radial alignment with respect to the turbine as well. By way of example, for a turbine shroud assembly 118, "circumferential" would refer to the circumference of a shroud ring as a whole rather than a particular dimension of a turbine shroud segment, and "radial" would similarly refer to alignment along a radius of the shroud ring as well. Alternatively, for a nozzle assembly 600 (see FIG. 6), "circumferentially oriented" indicates only that the circumferentially oriented flat spring 106 is disposed between the nozzle end wall 602 and the nozzle outer wall 604.

The compliant contact interface 110 between the first component 102 and the second component 104 may include a single circumferentially oriented flat spring 106 or a plurality of circumferentially oriented flat springs 106. In a further embodiment, the compliant contact interface 110 between the first component 102 and the second component 104 consists of the single circumferentially oriented flat spring 106 or the plurality of circumferentially oriented flat springs 106. In one embodiment, the compliant contact interface 110 is free of spring coils, elastomers, and woven metal meshes. The compliant contact interface 110 may preload the first component 102 to the second component 104 to a predetermined level.

The first component 102 includes a first coefficient of thermal expansion, and the second component 104 includes a second coefficient of thermal expansion. In one embodiment, wherein the first coefficient of thermal expansion is distinct from the second coefficient of thermal expansion, the turbine component assembly 100 includes a coefficient of thermal expansion variance. In a further embodiment, the first coefficient of thermal expansion is lower than the second coefficient of thermal expansion, and the first component 102 chords (flattens out) more than the second component 104 during operating conditions such as startup and steady state where the first component 102 is exposed to higher temperatures than the second component 104. The chording (flattening out) may be on the order of about 0.005 inches to about 0.025 inches.

In one embodiment, the compliant contact interface 110 reduces thermal binding under operating conditions relative to a comparative assembly not including the compliant contact interface 110. In another embodiment, the compliant contact interface 110 reduces wear of the first component 102 under operating conditions relative to a comparative assembly not including the compliant contact interface 110.

In one embodiment, the second component 104 includes a depression 114, and the circumferentially oriented flat spring 106 is partially inset into the depression 114. The circumferentially oriented flat spring 106 may protrude from the depression 114 such that the compliant contact interface 110 is raised relative to an adjacent surface 116 of the second component 104 or may be substantially flush with an adjacent surface 116.

The circumferentially oriented flat spring 106 may be joined to the second component 104 by any suitable joint, including, but not limited to, a braze joint, a weld joint, a bridle joint, a finger joint, a dovetail joint, a dado joint, a groove joint, a mortise and tenon joint, a cross lap joint, a splice joint, a tongue and groove joint, or combinations thereof. In one embodiment, the circumferentially oriented flat spring 106 is not joined to the second component 104, but rather is held in place relative to the first component 102 and the second component 104 by physical entrapment or compression of the first component 102 and the second component 104.

The first component 102 may include any suitable CMC composition, including, but not limited to, CMCs, aluminum oxide-fiber-reinforced aluminum oxides (Ox/Ox), carbon-fiber-reinforced carbon (C/C), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$) or combinations thereof.

The second component 104 may include any suitable composition, including, but not limited to, a metallic composition. Suitable metallic compositions may include, but are not limited to, iron alloys, steels, stainless steels, carbon steels, nickel alloys, superalloys, nickel-based superalloys, INCONEL 718, INCONEL 738, INCONEL X-750, René 41, cobalt-based superalloys, cobalt L-605, or combinations thereof.

The circumferentially oriented flat spring 106 may include any suitable composition, including, but not limited to, a metallic composition. Suitable metallic compositions may include, but are not limited to, superalloys, nickel-based superalloys, cobalt-based superalloys, INCONEL 718, INCONEL X-750, René 41, cobalt L-605, or combinations thereof.

In one embodiment, the circumferentially oriented flat spring 106 includes a hard wear surface coating disposed such that the compliant contact interface 110 includes the hard wear surface coating. The hard wear surface coating may include any suitable coating composition, including, but not limited to, STELLITE 720 ULTRAFLEX, STELLITE 6, STELLITE 6B, STELLITE 6K, STELLITE 21, TRIBALLOY T-400, TRIBALLOY T-400C, TRIBALLOY T-800, X-40, X-45, FSX-414, copper alloys, MONEL alloys, MONEL 400, MONEL 401, MONEL 404, MONEL K-500, MONEL 405, aluminum bronzes, INCONEL 625, INCONEL 718, INCONEL 738, or combinations thereof.

As used herein, "cobalt L-605" refers to an alloy including a composition, by weight, of about 20% chromium, about 10% nickel, about 15% tungsten, about 0.1% carbon, about 1.5% manganese, and a balance of cobalt. Cobalt L-605 is available from Special Metals Corporation, 3200 Riverside Drive, Huntington, W. Va. 25720.

As used herein, "FSX-414" refers to an alloy including a composition, by weight, of about 29% chromium, about 7% tungsten, about 10% nickel, about 0.6% carbon, and a balance of cobalt. FSX-414 is commercially available under that designation As used herein, "INCONEL 625" refers to an alloy including a composition, by weight, of about 21.5% chromium, about 5% iron, about 9% molybdenum, about 3.65% niobium, about 1% cobalt, about 0.5% manganese, about 0.4% aluminum, about 0.4% titanium, about 0.5% silicon, about 0.1% carbon, and a balance of nickel. INCONEL 625 is available from Special Metals Corporation, 3200 Riverside Drive, Huntington, W. Va. 25720.

As used herein, "INCONEL 718" refers to an alloy including a composition, by weight, of about 19% chromium, about 18.5% iron, about 3% molybdenum, about 3.6% niobium and tantalum, and a balance of nickel. INCONEL 718 is available from Special Metals Corporation, 3200 Riverside Drive, Huntington, W. Va. 25720.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel. INCONEL 738 is available from Special Metals Corporation, 3200 Riverside Drive, Huntington, W. Va. 25720.

As used herein, "INCONEL X-750" refers to an alloy including a composition, by weight, of about 15.5% chromium, about 7% iron, about 2.5% titanium, about 0.7% aluminum, and about 0.5% niobium and tantalum, and a balance of nickel. INCONEL X-750 is available from Special Metals Corporation, 3200 Riverside Drive, Huntington, W. Va. 25720.

As used herein, "MONEL 400" refers to an alloy including a composition, by weight, of at least about 63% nickel, up to about 2.5% iron, up to about 2% manganese, up to about 0.5% silicon, and a balance of copper. MONEL 400 is available from Special Metals Corporation, 3200 Riverside Drive, Huntington, W. Va. 25720.

As used herein, "MONEL 401" refers to an alloy including a composition, by weight, of at least about 63% nickel, up to about 2.5% iron, up to about 2% manganese, and a balance of copper. MONEL 401 is available from Special Metals Corporation, 3200 Riverside Drive, Huntington, W. Va. 25720.

As used herein, "MONEL 404" refers to an alloy including a composition, by weight, of about 54.5% nickel, up to about 0.5% iron, up to about 0.1% manganese, up to about 0.1% silicon, up to about 0.05% aluminum, and a balance of copper. MONEL 404 is available from Special Metals Corporation, 3200 Riverside Drive, Huntington, W. Va. 25720.

As used herein, "MONEL K-500" refers to an alloy including a composition, by weight, of at least about 63% nickel, up to about 2% iron, up to about 1.5% manganese, up to about 0.5% silicon, about 2.75% aluminum, about 0.6% titanium, and a balance of copper. MONEL K-500 is available from Special Metals Corporation, 3200 Riverside Drive, Huntington, W. Va. 25720.

As used herein, "MONEL 405" refers to an alloy including a composition, by weight, of at least about 63% nickel, up to about 2.5% iron, up to about 2% manganese, up to about 0.5% silicon, up to about 0.05% aluminum, and a balance of copper. MONEL 405 is available from Special Metals Corporation, 3200 Riverside Drive, Huntington, W. Va. 25720.

As used herein, "René 41" refers to an alloy including a composition, by weight, of about 19% chromium, about 11% cobalt, about 10% molybdenum, about 1.5% aluminum, about 3.1% titanium, and a balance of nickel. René 41 is commercially available under that designation.

As used herein "STELLITE 6" refers to an alloy including, by weight, about 30% chromium, about 4.5% tungsten, about 1.2% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 6B" refers to an alloy including, by weight, about 29% chromium, about 4.5% tungsten, about 1.2% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 6K" refers to an alloy including, by weight, about 30% chromium, about 4.5% tungsten, about 1.7% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 21" refers to an alloy including, by weight, about 28% chromium, about 3% nickel, about 5.2% molybdenum, about 0.25% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 720 ULTRAFLEX" refers to an alloy including, by weight, about 33% chromium, about 2.45% carbon, about 18% molybdenum, about 0.5% silicon, and a balance of cobalt. STELLITE 720 ULTRAFLEX is available from Deloro Wear Solutions GmbH, Zur Bergpflege 51-53, 56070 Koblenz, Germany.

As used herein, "TRIBALOY T-400" refers to an alloy including a composition, by weight, of about 8.5% chromium, about 28% molybdenum, about 2.5% silicon, and a balance of cobalt. TRIBALOY T-800 is available from Kennametal Inc., 1662 MacMillan Park Drive, Fort Mill, S.C. 29707.

As used herein, "TRIBALOY T-400C" refers to an alloy including a composition, by weight, of about 14% chromium, about 27% molybdenum, about 2.6% silicon, and a balance of cobalt. TRIBALOY T-800 is available from Kennametal Inc., 1662 MacMillan Park Drive, Fort Mill, S.C. 29707.

As used herein, "TRIBALOY T-800" refers to an alloy including a composition, by weight, of about 18% chromium, about 28% molybdenum, about 3.4% silicon, and a balance of cobalt. TRIBALOY T-800 is available from Kennametal Inc., 1662 MacMillan Park Drive, Fort Mill, S.C. 29707.

As used herein, "X-40" refers to an alloy including a composition, by weight, of about 10% nickel, about 25% chromium, about 7.5% tungsten, about 0.45% carbon, and a balance of cobalt. X-40 is commercially available under that designation.

As used herein, "X-45" refers to an alloy including a composition, by weight, of about 10% nickel, about 25% chromium, about 7.5% tungsten, about 0.5% manganese, about 0.9% silicon, and a balance of cobalt. X-45 is commercially available under that designation.

Referring to FIGS. 1-5, the circumferentially oriented flat spring 106 may include any suitable conformation, including, but not limited to a leaf spring 124 (FIGS. 1-3), a circumferential sinusoidal conformation 300 (FIG. 4), a circumferential corrugated conformation 400 (FIG. 5), or combinations thereof. As used herein, a "leaf spring" indicates a curved conformation having up to one period of a waveform and a single crest, a "circumferential sinusoidal conformation" indicates a curved conformation having more than one period and a plurality of crests, and a "circumferential corrugated conformation" indicates a non-curved waveform such as a triangular waveform or a saw tooth waveform.

Figure 6:
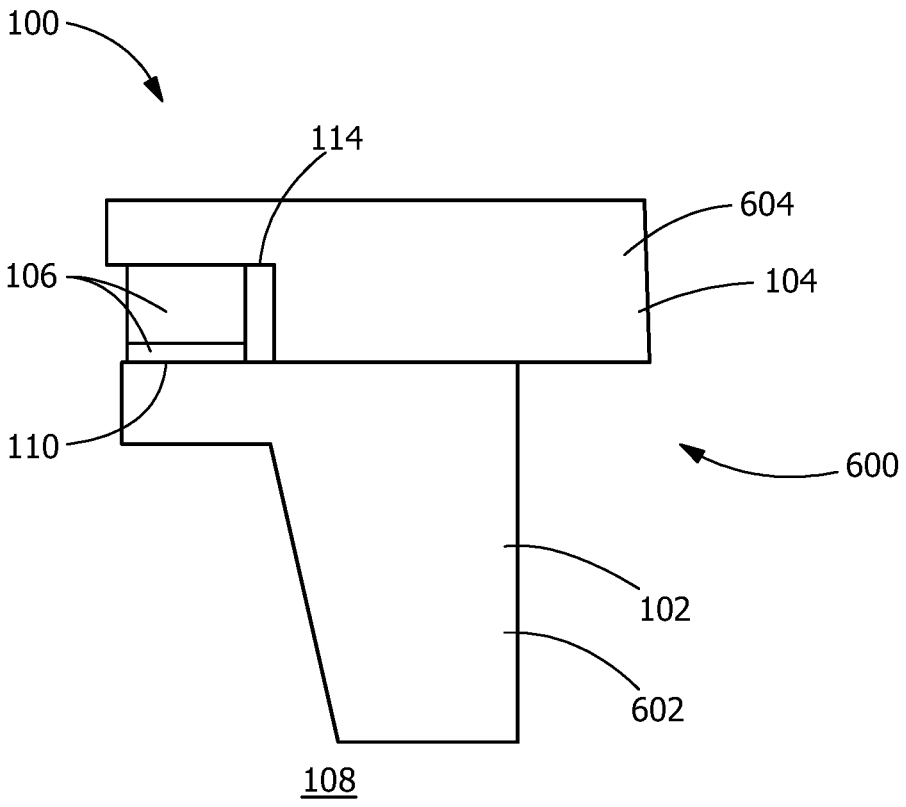
FIG. 6 is a cross-sectional view of a turbine component assembly wherein the turbine component assembly is a nozzle assembly, according to an embodiment of the present disclosure.

Referring to FIGS. 1,2, and 6, the turbine component assembly 100 may be any suitable apparatus, including, but not limited to, a shroud assembly 118 (FIGS. 1 and 2) wherein the first component 102 is an inner shroud 120 and the second component 104 is an outer shroud 122, a nozzle assembly 600 (FIG. 6) wherein the first component 102 is a nozzle end wall 602 and the second component 104 is a nozzle outer wall 604, a combustor (not shown) wherein the first component 102 is a combustor liner and the second component 104 is a combustor case, or a combustor tile (not shown) wherein the first component 102 is a combustion chamber-facing portion and the second component 104 is a combustor case-facing portion.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine component assembly, comprising:

a first component arranged to be disposed adjacent to a hot gas path, the first component including a ceramic matrix composite (CMC) composition;

a second component adjacent to the first component and arranged to be disposed distal from the hot gas path across the first component; and a circumferentially oriented flat spring, wherein the circumferentially oriented flat spring:

is disposed on and directly contacts the second component in at least two discrete locations such that a portion of the circumferentially oriented flat spring between the at least two discrete locations is not in contact with the second component;

directly contacts and supports the first component along the portion of the circumferentially oriented flat spring between the at least two discrete locations as a compliant contact interface between the first component and the second component;

provides a radial spring compliance between the first component and the second component;

is aligned along a path between the at least two discrete locations; and includes:

a first lateral face extending along the path between the at least two discrete locations which contacts the first component between the at least two discrete locations:

a second lateral face extending along the path between the at least two discrete locations being disposed opposite from the first lateral face:

a third lateral face extending along the path between the at least two discrete locations connecting the first lateral face and the second lateral face, entirety of the third lateral face facing the second component; and a fourth lateral face extending along the path between the at least two discrete locations connecting the first lateral face and the second lateral face and being disposed opposite from the third lateral face, entirety of the fourth lateral face facing away from the second component.

2. The turbine component assembly of claim 1, further including a coefficient of thermal expansion variance between the first component and the second component.

3. The turbine component assembly of claim 1, wherein the second component includes a depression, and the circumferentially oriented flat spring is partially inset into the depression.

4. The turbine component assembly of claim 3, wherein the circumferentially oriented flat spring protrudes from the depression such that the compliant contact interface is raised relative to an adjacent surface of the second component.

5. The turbine component assembly of claim 1, wherein the circumferentially oriented flat spring is a leaf spring.

6. The turbine component assembly of claim 1, wherein the circumferentially oriented flat spring includes a circumferential sinusoidal conformation.

7. The turbine component assembly of claim 1, wherein the circumferentially oriented flat spring includes a circumferential corrugated conformation.

8. The turbine component assembly of claim 1, wherein the circumferentially oriented flat spring is joined to the second component by a joint selected from the group consisting of a braze joint, a weld joint, a bridle joint, a finger joint, a dovetail joint, a dado joint, a groove joint, a mortise and tenon joint, a cross lap joint, a splice joint, a tongue and groove joint, and combinations thereof.

9. The turbine component assembly of claim 1, wherein the compliant contact interface between the first component and the second component consists of the circumferentially oriented flat spring.

10. The turbine component assembly of claim 1, wherein the compliant contact interface between the first component and the second component includes a plurality of the circumferentially oriented flat spring.

11. The turbine component assembly of claim 1, wherein the turbine component assembly is a shroud assembly, the first component is an inner shroud, and the second component is an outer shroud.

12. The turbine component assembly of claim 1, wherein the turbine component assembly is a nozzle assembly, the first component is a nozzle end wall, the second component is a nozzle outer wall.

13. The turbine component assembly of claim 1, wherein the second component is metallic.

14. The turbine component assembly of claim 1, wherein the compliant contact interface reduces thermal binding relative to a comparative assembly not including the compliant contact interface.

15. The turbine component assembly of claim 1, wherein the compliant contact interface reduces wear of the first component relative to a comparative assembly not including the compliant contact interface.

16. The turbine component assembly of claim 1, wherein the compliant contact interface preloads the first component to the second component to a predetermined level.

17. The turbine component assembly of claim 1, wherein the compliant contact interface includes a hard wear surface coating.

18. The turbine component assembly of claim 17, wherein the hard wear surface coating is selected from the group consisting of STELLITE 720 ULTRAFLEX, STELLITE 6, STELLITE 6B, STELLITE 6K, STELLITE 21, TRIBALLOY T-400, TRIBALLOY T-400C, TRIBALLOY T-800, X-40, X-45, FSX-414, copper alloys, MONEL alloys, MONEL 400, MONEL 401, MONEL 404, MONEL K-500, MONEL 405, aluminum bronzes, INCONEL 625, INCONEL 718, INCONEL 738, and combinations thereof.

19. The turbine component assembly of claim 1, wherein the compliant contact interface is free of spring coils, elastomers, and woven metal meshes.

20. The turbine component assembly of claim 1, wherein the circumferentially oriented flat spring comprises at least one apex along the path between the at least two discrete locations, and the at least one apex directly contacts the first component.

* * * * *